US008127925B2

(12) United States Patent
Block

(10) Patent No.: US 8,127,925 B2
(45) **Date of Patent: *Mar. 6, 2012**

(54) CONTAINER PACKAGE AND DISPENSER

(75) Inventor: Steven J. Block, Amelia, OH (US)

(73) Assignee: The C.W. Zumbiel Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/109,059

(22) Filed: May 17, 2011

(65) Prior Publication Data

US 2011/0215016 A1 Sep. 8, 2011

Related U.S. Application Data

(63) Continuation-in-part of application No. 12/252,601, filed on Oct. 16, 2008, now Pat. No. 7,942,263.

(51) Int. Cl.
*B65D 65/00* (2006.01)

(52) U.S. Cl. ..... 206/432; 206/497

(58) Field of Classification Search ..... 206/427–432, 206/434, 497

See application file for complete search history.

(56) References Cited

U.S. PATENT DOCUMENTS 2,654,474 A 10/1953 Ringler
2,705,556 A 4/1955 Ringler
3,118,537 A 1/1964 Copping
3,144,130 A 8/1964 Copping
3,206,020 A 9/1965 Billingsley et al.
3,217,874 A 11/1965 Potter
3,219,183 A 11/1965 Potter et al.
3,302,783 A 2/1967 Lyon
3,302,784 A * 2/1967 Copping ..... 206/432
3,331,503 A 7/1967 Brown
3,338,404 A 8/1967 Becker et al.
3,347,365 A 10/1967 Funkhouser
3,353,326 A 11/1967 Becker (Continued)

OTHER PUBLICATIONS

The International Search Report and the Written Opinion of the International Searching Authority, or the Declaration, International Searching Authority, PCT/US2009/054247, Oct. 14, 2009, 8 pgs.

*Primary Examiner* — Luan K Bui
(74) *Attorney, Agent, or Firm* — Wood, Herron & Evans, LLP

(57) ABSTRACT

A package for a number of beverage or non-beverage containers includes an overlay member covering the top or bottom ends of the containers. The overlay member has a central, generally planar panel positioned on the ends of the containers and may include a number of perimeter panels each joined to and positioned on a perimeter of the central panel. Each perimeter panel is oriented generally perpendicularly relative to the central panel. A dispenser opening is in the central panel of the overlay member through which the containers may be removed from the package. An overwrap member such as a thermoplastic shrink wrap film envelops the array of containers and the overlay member to provide a robust, unitary package for transport and storage. A line of weakness in the overwrap member is aligned with the dispenser to allow a user to puncture the overwrap member in the vicinity of the line of weakness and gain access to the containers via the dispenser. The package may be supported on a shelf such as within a refrigerator or storage rack with a side of the package facing downwardly and the dispenser positioned proximate the downwardly facing side of the package.

20 Claims, 7 Drawing Sheets

U.S. PATENT DOCUMENTS 3,385,429 A 5/1968 Becker
3,388,788 A 6/1968 Hellem
3,403,779 A 10/1968 Becker et al.
3,477,564 A 11/1969 Crabtree
3,488,913 A 1/1970 Burgess
3,491,878 A 1/1970 Britton et al.
3,525,428 A 8/1970 Stephan
3,532,214 A 10/1970 Helms
3,542,193 A * 11/1970 Hewlett et al. ..... 206/497
3,552,559 A 1/1971 Kirby, Jr.
3,600,872 A 8/1971 Sharpnack
RE27,212 E 11/1971 Brown
3,650,394 A 3/1972 De Cazenove
3,650,395 A 3/1972 Hobbs
T900,020 I4 7/1972 Britt et al.
3,674,136 A 7/1972 Forrer
3,675,767 A 7/1972 Taylor
3,687,282 A 8/1972 Owen
3,688,972 A 9/1972 Mahon
3,690,453 A 9/1972 Dorall
3,693,787 A * 9/1972 Duerr ..... 206/432
3,734,280 A 5/1973 Amneus et al.
3,747,749 A * 7/1973 Brown ..... 206/432
3,747,750 A 7/1973 Chapman
3,750,876 A 8/1973 Throberg
3,756,397 A 9/1973 Ganz
3,866,818 A 2/1975 Smith
3,883,000 A 5/1975 Gibbs
4,036,362 A 7/1977 Ullman
4,062,448 A 12/1977 Meighan
4,077,516 A 3/1978 Duerr
4,078,659 A 3/1978 Rensner
4,094,406 A 6/1978 Zietzschmann
4,212,955 A 7/1980 Tobias et al.
4,224,416 A 9/1980 Taylor et al.
4,304,332 A 12/1981 Danti
4,333,570 A 6/1982 Heider
4,382,506 A 5/1983 Chaussadas
4,475,653 A 10/1984 Ullman
4,567,981 A 2/1986 Headon
4,586,312 A 5/1986 Limousin
4,609,101 A 9/1986 Ullman
4,779,731 A 10/1988 Fujio
4,789,063 A 12/1988 Hammett
4,807,751 A 2/1989 Klygis et al.
4,919,265 A 4/1990 Lems et al.
4,953,702 A 9/1990 Bryan
4,971,197 A 11/1990 Worley
4,998,615 A 3/1991 Bryan
4,998,619 A 3/1991 Sowa et al.
5,016,761 A 5/1991 Stoddard et al.
5,035,323 A 7/1991 Daniels et al.
5,154,289 A 10/1992 Van Erden
5,160,030 A * 11/1992 Binsfeld ..... 206/497
5,201,463 A 4/1993 George
5,249,738 A 10/1993 Werth
5,282,348 A 2/1994 Dampier et al.
5,363,954 A 11/1994 Dampier et al.
5,551,563 A 9/1996 Allen
5,624,031 A * 4/1997 Fowler et al. ..... 206/497
5,685,428 A 11/1997 Herbers et al.
5,755,326 A 5/1998 O'Neill
5,813,540 A 9/1998 Vollbrecht et al.
5,887,717 A 3/1999 Anderson et al.
6,050,058 A 4/2000 Loreto et al.
6,105,776 A 8/2000 Meilhon
6,182,422 B1 2/2001 Andersen et al.
6,499,596 B1 12/2002 Andersen et al.
6,588,594 B2 7/2003 Andersen et al.
6,874,633 B2 4/2005 Andersen et al.
6,978,892 B2 12/2005 Bansal et al.
6,978,895 B2 12/2005 Tumminia
7,370,761 B2 5/2008 Andersen et al.
7,392,905 B2 7/2008 Andersen et al.
7,823,721 B2 11/2010 Sutherland et al.
2003/0155266 A1 8/2003 Andersen et al.
2005/0139502 A1 6/2005 Andersen et al.
2006/0186009 A1 8/2006 Perkinson
2007/0080087 A1 4/2007 Lentner et al.
2007/0205255 A1 9/2007 Dunn
2007/0215504 A1 9/2007 Walker
2007/0215505 A1 9/2007 Walker
2009/0127147 A1 5/2009 Sutherland

* cited by examiner

CONTAINER PACKAGE AND DISPENSER

This is a continuation in part of U.S. patent application Ser. No. 12/252,601, filed Oct. 16, 2008, and issued as U.S. Pat. No. 7,942,263 on May 17, 2011. This also claims priority to PCT Application No. PCT/US2009/054247, filed Aug. 19, 2009, designating the U.S. and published as International Publication No. WO 2010/044951 on Apr. 22, 2010. Each of these identified patent properties is hereby incorporated by reference in its entirety.

BACKGROUND OF THE INVENTION

This invention relates generally to packages for containers, bottles and cans with beverage or non-beverage contents therein, and more particularly to a package that is economical to manufacture, robust in use and from which the containers can be easily and conveniently dispensed.

The packaging of multiple containers such as beverage bottles and cans has for many years been achieved by the use of pre-scored and pre-folded paperboard cartons or carriers which encircle the containers. Recently, a trend toward cheaper thermoplastic film materials which can be heat shrunk into close conforming relationship to a group of containers for beverage and non-beverage items has emerged. While such shrink wrap packages may be more economical than the paperboard cartons and carriers, the shrink wrap film readily tears at high stress concentration areas of the package due to the thin film that is used in providing a more economical package. In those instances where the film has been strong enough, typically because the films are thicker, to prevent accidental tearing of the package, the packages have been relatively difficult for the consumer to open and conveniently gain access to the containers therein.

Several attempts have been made to strike a balance that appears necessary to produce a commercial thermoplastic film-type package. It has been difficult, however, to provide an economical package which combines the requisite strength for handling and at the same time offers convenient access to the containers for the consumer.

Additionally, the efficient and economical packaging process for beverage and non-beverage containers is a continuing objective for the packaging industry. An important aspect of any beverage and non-beverage package is the ability to assemble, transfer, coordinate and package the containers in a commercially advantageous manner. A beverage or non-beverage container package that is economical, robust and convenient for the consumer to use, but which is difficult to assembly and package does not satisfy the commercial requirements associated with such products.

Bottled water has become very popular for retail purchase and PET bottles are commonly used as the container. Similar to many consumer beverages, the bottles are sold in packages of typically at least four bottles up to as many as 24 to 36 or more per package. However, unlike packaging for soda, soft drinks and beer, bottled water packages and many non-beverage packages such as pet food packages are typically very basic and conventional consisting of a paperboard tray supporting the bottom of the containers and the entire package being enveloped in shrink wrap plastic or the like. The relatively low level of sophistication for these types of packages is, in part, a result of the low profit margins and economic limitations associated with the sales of such products. Manufacturers and bottlers are not able to economically justify the added cost of production associated with sophisticated packages and dispensers for bottled water and many other items while still maintaining competitive retail pricing.

Additionally, consumers commonly purchase large quantities of bottled water and other non-beverage items and often each package includes 24 to 36 or more containers. It is difficult, if not impossible, for a consumer to conveniently transfer the entire package to their refrigerator for cooling, or pantry for storage and convenient access. As an alternative, consumers often remove individual bottles or containers from the package for use or transfer to the refrigerator or pantry and this piece-meal dispensing of the containers is inconvenient and continual attention to stocking and re-stocking the refrigerator or pantry with bottled water, pet food or the like is required.

Therefore, an improved package for bottled water and other beverage or non-beverage containers is needed that satisfies these and other shortcomings associated with known container packages.

SUMMARY OF THE INVENTION

This invention solves these and other problems and, in one embodiment, includes a paperboard overlay member of a size to cover the longitudinal ends (tops or bottoms) of the assembled containers whether they are beverage bottles or non-beverage containers such as pet food cans. In one embodiment, the package includes 12 PET bottles in a 4×3 arrangement, but other sizes of packages and arrangements of containers for beverage or non-beverage items are possible with this invention. The rectangular shape of the overlay member is sized to cover the top caps or bottoms of the containers and perimeter panels extending from each edge of a central, rectangular panel of the overlay member are folded downwardly to form a tray. Ultimately, the tray may be inverted, upwardly facing or on an edge in a vertical orientation depending upon the particular use of the package and dispenser of this invention. The tray includes one or more dispensers in the rectangular central panel. Each dispenser in one embodiment includes a dispenser flap adjacent one of the longitudinal or lateral edges of the central panel. Perforated tear lines are provided at the perimeter edge of the dispenser flap to allow the flap to be folded perpendicular to the plane of the overlay member panel. The dispenser may include a dispenser opening cut-out portion in the overlay member alone or in combination with and adjacent to the dispenser flap.

After the containers are arranged in the desired configuration and the overlay member is placed atop the caps or beneath the container bottoms with the perimeter panels folded, the package is enveloped in an overwrap member such as thermoplastic shrink wrap film as is well known in the industry. The package is easily handled, sturdy and well constructed for shipping, storing and merchandising. In one aspect of this invention, the dispenser opening in the overlay member is sized, positioned, and configured so as not to interfere with the containers being assembled and positioned relative to the overlay member. For example, the dispenser opening size, placement and shape will not catch the base or tip the bottle when the bottle slides atop the overlay member during the assembly and packaging process.

Once the consumer brings the package home, they can easily place it in the refrigerator, pantry or on a shelf with the overlay member and container ends facing forwardly or upwardly. Perforations, seams or scores are provided in the overwrap and in registration with the dispenser flap and/or dispenser opening in the overlay member so that a user may easily insert their hand through the shrink wrap and into the cut-out, tear the shrink wrap in the region of the dispenser flap, tear the dispenser flap along the perforations in the overlay member and fold the flap downwardly toward the shelf or outwardly exposing the dispenser opening. As such, the package is conveniently stored on the shelf of a refrigerator or elsewhere and individual bottles can be accessed from the package through the dispenser all without compromising the integrity of the package and remaining containers therein. This robust and easy to use package is provided with a minimum of cost to the bottler, producer, manufacturer, retailer and consumer.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 2:
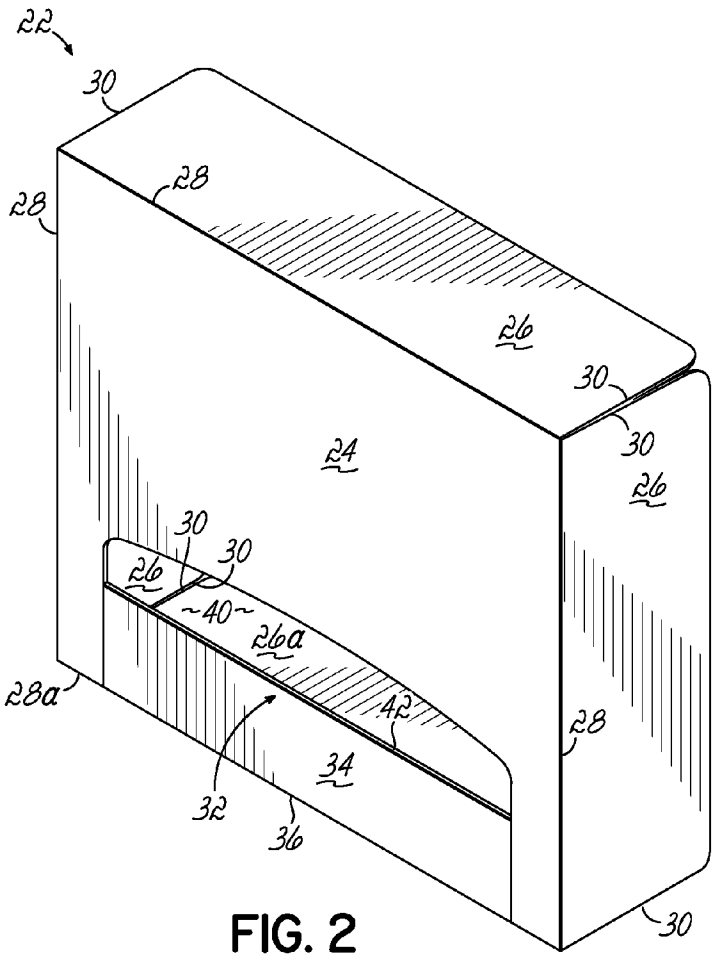
FIG. 2 is a perspective view of the overlay member of FIG. 1 an erected and folded configuration.
Figure 1:
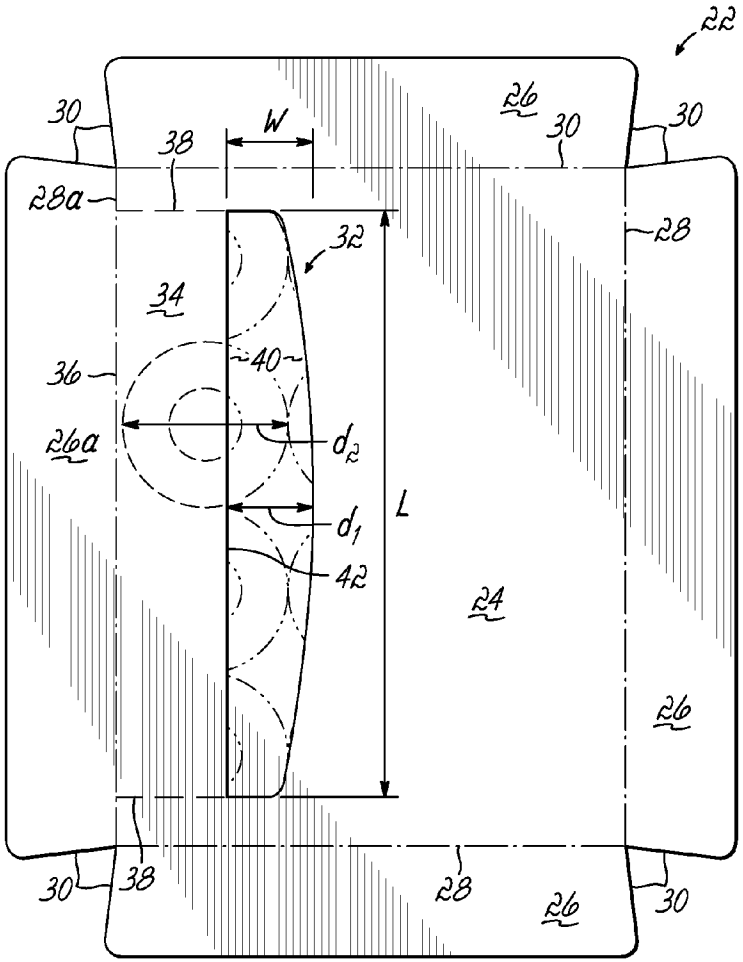
FIG. 1 is a plan view of an overlay member of a package according to one embodiment of this invention.
Figure 3:
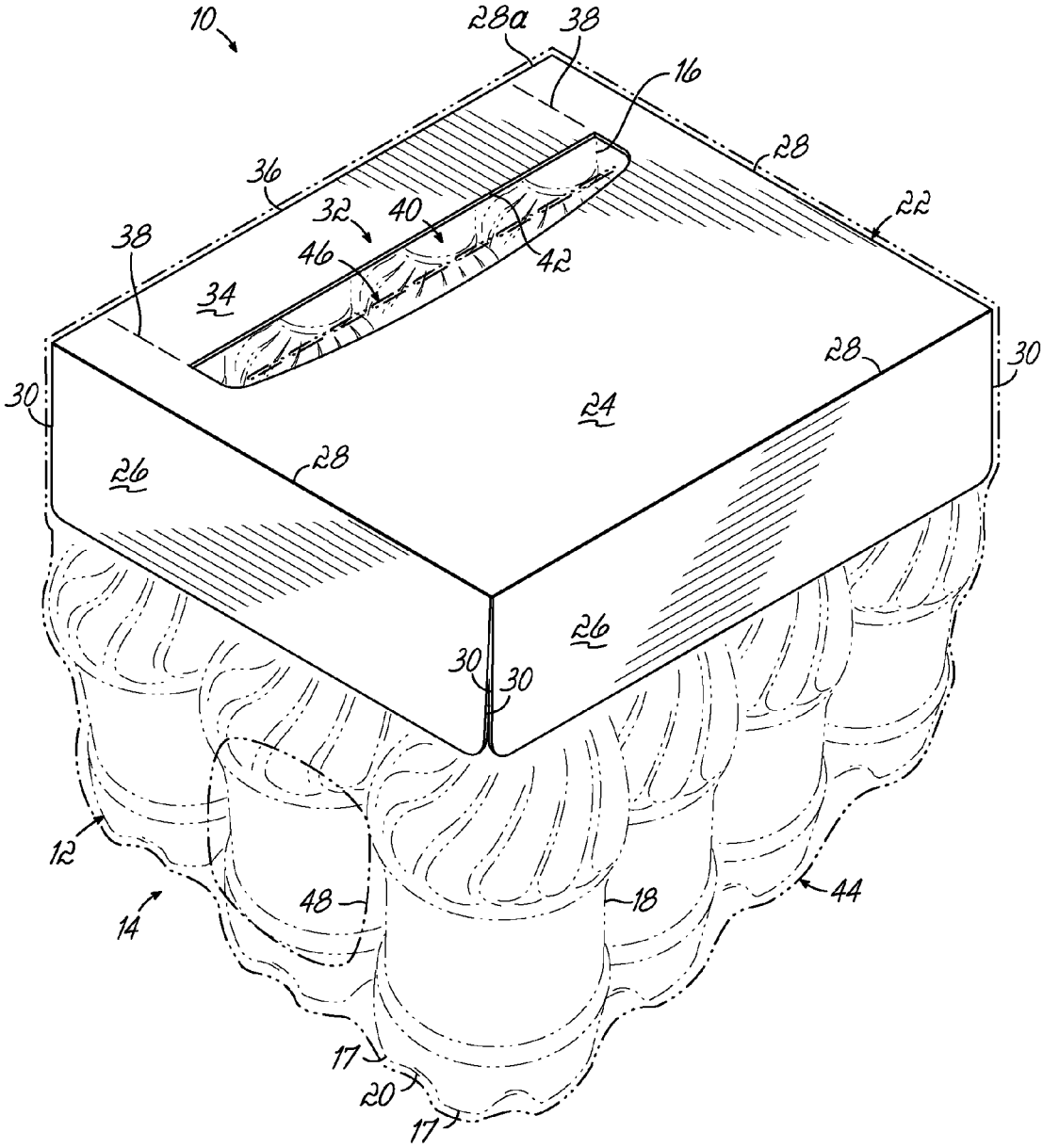
FIG. 3 is a perspective view of the erected overlay member of FIG. 2 in position relative to a number of beverage containers and encased by an overwrap member to form a beverage package according to one embodiment of this invention.

Referring to FIGS. 1-3, one embodiment of a package 10 according to this invention is shown for beverage containers 12. The beverage containers 12 as shown in FIG. 3 are arranged in a single layer array 14 in a 4×3 matrix. Each beverage container 12 as shown in FIG. 3 is a polyethylene terephthalate (PET) bottle having an upper opening closed by a bottle cap 16, an arcuate sidewall 18 and a base or bottom 20. The bottom 20 of each PET bottle as shown in FIGS. 1-3 may have a number of spaced pedestals, protuberances or feet 17 as is common with PET bottles. While PET bottles are shown arranged in a 4×3 matrix array 14 in FIG. 3, this invention is readily applicable for beverage and non-beverage containers 12 of a different type, style, arrangement and number. For example, it is well recognized in the industry that beverages are available for retail sale in PET bottles and other bottle materials such as glass or another plastic, aluminum cans, foil pouches or any container material and configuration. Likewise, while a 4×3 matrix of beverage containers 12 is shown in FIG. 3, other arrangements and assembly of beverage and non-beverage containers 12 are available within the scope of this invention, including multi-layer arrangements and the like.

The package 10 according to one embodiment of this invention includes an overlay member 22, one embodiment of which is shown in FIGS. 1-2. According to one embodiment and as shown in FIGS. 1-2, the overlay member 22 is a paperboard sheet material of 0.018 carrier board. However, other materials including corrugated plastic and other configurations of the overlay member 22 may be utilized within the scope of this invention. The overlay member 22 of FIGS. 1-2 has a generally rectangular and planar central panel 24 of a size and configuration to cover the bottle caps 16 and top ends of the array 14 of beverage containers 12 in the package 10. In one embodiment, the bottle caps 16 and top ends of the beverage containers 12 do not project or protrude through the overlay member 22 according to this invention. According to varied aspects of this invention, the overlay member may be positioned on the longitudinal ends of the assembled containers 12, such as the top end caps 16 as shown in FIG. 3 or the bottoms 20 of the containers 12.

Perimeter panels 26 are each joined to and positioned on respective perimeter edges of the central panel 24 as shown particularly in FIG. 1. A score, crease or fold line 28 is provided at the juncture of each perimeter panel 26 and the associated edge of the central panel 24 so that the associated perimeter panel 26 may be folded approximately 90° relative to the plane of the central panel 24. When each of the perimeter panels 26 is folded along the associated fold line 28, the overlay member 22 is formed into a tray-like configuration as shown in FIG. 2. In one embodiment, each perimeter panel 26 has tapered or flared side edges 30 so that when each of the perimeter panels 26 is folded into the configuration of FIG. 2, it does not interfere with the adjacent perimeter panels 26 in forming the tray configuration of FIG. 2.

The package 10 of one embodiment of this invention includes a dispenser 32 through which the containers 12 in the package 10 may be accessed and removed. In one embodiment, the dispenser 32 includes a dispenser flap 34 in the central panel 24 of the overlay member 22. The dispenser flap 34 is positioned adjacent a perimeter edge 36 of the central panel 24 of the overlay member 22 along the fold line **28*a* joining the associated perimeter panel 26*a*. In the embodiment of FIGS. 1-4, the dispenser 32 is adjacent a longitudinal perimeter edge 36 of the central panel 24. The longitudinal perimeter edge is longer than the lateral perimeter edge of the overlay member 22 and the larger dimension of the array 14 of containers is aligned with the longitudinal perimeter edge. For example, the 4×3 array of containers 12 shown in FIGS. 2-4 has four containers 12 aligned in the longitudinal direction with the dispenser 32 and three containers 12 are aligned in the lateral direction. A pair of tear lines 38 for the dispenser 32 may be perforations or another other type of tear line, emanate from the fold line 28*a* and are oriented generally perpendicular to the fold line 28*a* as shown particularly in FIG. 1**.

The dispenser 32 according to one embodiment of this invention also includes a dispenser opening 40 in the central panel 24 of the overlay member 22. The dispenser opening 40 of one embodiment as shown in FIGS. 1-2 has a longitudinal length L and a lateral width W. The dispenser opening 40 is positioned adjacent to a terminal free edge 42 of the dispenser flap 34 and is oriented longitudinally in the central panel 24 and adjacent one longitudinal side edge 36 of the central panel 24. As shown in FIGS. 1-2, the dispenser 32 of one embodiment of this invention is positioned asymmetrically relative to a longitudinal axis of the overlay member 22 and package 10. The terminal free edge 42 of the dispenser flap 34 borders the dispenser opening 40 according to one embodiment of this invention. However, a dispenser 32 according to this invention may include only the dispenser flap 34, only the dispenser opening 40, a combination of the dispenser flap 34 and the dispenser opening 40 as shown in FIGS. 1-2 or any other arrangement and placement. Other arrangements, designs, placement or configurations for the dispenser 32 are available within the scope of this invention, including multiple dispensers 32 in a single overlay member 22.

The overlay member 22 with the perimeter panels 26, 26*a* folded as shown in FIG. 2 may be positioned atop the caps 16 of the beverage containers 12 as shown in FIG. 3. The overlay member 22 may also be positioned on the bottoms 20 of the containers 12. The package 10 according to one embodiment of this invention also includes an overwrap member 44 which envelopes or covers at least a substantial portion of the array 14 of beverage containers 12 and the overlay member 22. In one embodiment, the overwrap member 44 may be a thermoplastic heat-shrinkable film applied around the overlay member 22 and containers 12 and heated in a heat-shrink oven to form a tightly conforming overwrap member 44. Heat-shrink plastic films and associated heat-shrink technology are well known in the industry for enveloping beverage containers 12 and such technology is readily available from Lantech (Lantech.com) as well as other shrink-wrap equipment providers.

The overwrap member 44 in one embodiment of this invention may include a weakened portion 46 relative to the remainder of the overwrap member 44. The weakened portion 46 may be a frangible access portion defined by a line or configuration of perforations in the overwrap member 44. The weakened portion 46 may also be a crease, fold, score or discontinuity in the overwrap member 44. The weakened portion 46 is positioned relative to the dispenser 32 to allow a user to puncture the overwrap member 44 in the vicinity of the dispenser 32 to gain access to the containers 12 in the package 10 via the dispenser 32. In the embodiment shown in FIG. 3, the weakened portion 46 of the overwrap member 44 is a line of perforations extending longitudinally on the package 10 and positioned and aligned relative to or within the dispenser opening 40. While a single line of perforations in the overwrap member 44 is shown in FIG. 3, the weakened portion 46 of the overwrap member 44 may be any configuration or design in addition to the perforations or a line thereof within the scope of this invention.

The overwrap member 44 substantially covers the containers 12 and overlay member 22, but a small portion 48 of the package 10 may not be enveloped by the overwrap member 44 as shown in FIG. 3 and as is well known in the industry. Nevertheless, the overwrap member unifies the array 14 of containers 12 and overlay member 22 into a robust unitary package 10.

Figure 4:
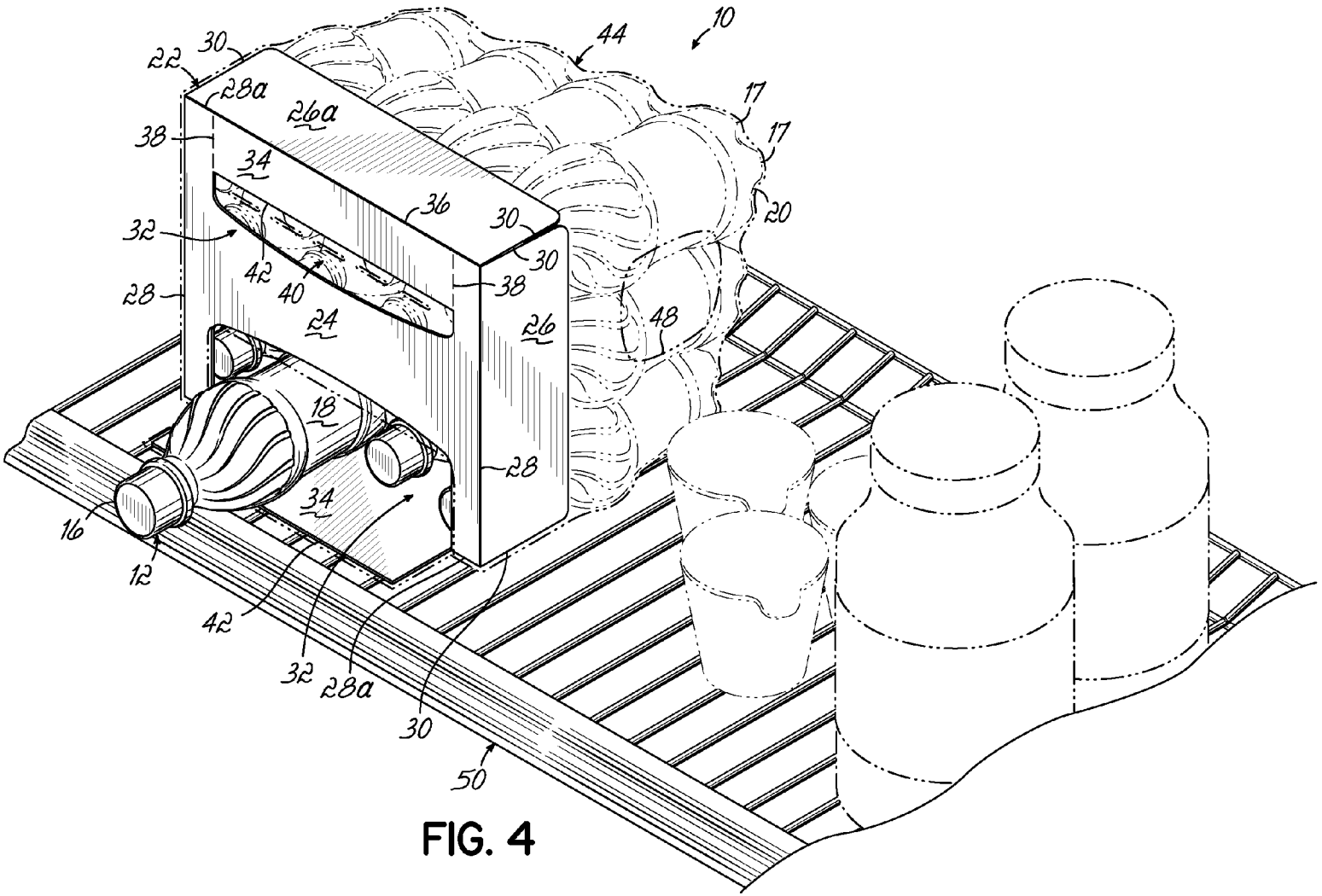
FIG. 4 is a view similar to FIG. 3 showing one of the beverage containers of the package being removed through a dispenser of the package with the package supported on a shelf.

A user, such as a consumer or retail purchaser of the package 10, may place the package 10 on a shelf 50 of a refrigerator, pantry, storage cabinet or the like as is shown in FIG. 4. In one embodiment, the package 10 is reoriented so that the containers 12 and package 10 lay on one of its sides with the dispenser 32 positioned adjacent the shelf 50 so the containers 12 are removed horizontally from the package 10. Alternately, the containers 12 in the package 10 may be removed vertically from the package 10 through the dispenser 32 even when the containers 12 are upright as in FIG. 3.

Nevertheless, the package 10 may be shipped, stored or otherwise processed with the containers 12 in the upright configuration of FIG. 3 and may then be rotated to the orientation of FIG. 4 for consumer use and dispensing of the containers 12. A user merely inserts his or her fingers through the weakened portion 46 of the overwrap member 44 and into the dispenser 32 thereby tearing the overwrap member 44 while grasping the dispenser flap 34 and pulling it outwardly from the plane of the central panel 24. The dispenser flap 34 tears along the tear lines 38 so that it may be positioned in a generally horizontal orientation as in FIG. 4 or generally vertically as in FIG. 3, perpendicular to the central panel 24 and generally parallel with the associated perimeter panel 26*a*, if provided. As such, the dispenser 32 provides access through which a user may grasp and retrieve one of the containers 12 of the package 10. The dispenser 32 according to one embodiment of this invention as shown in FIG. 4 provides access to more than one of the beverage containers 12 and, as each beverage container 12 is removed from the package 10 through the dispenser 32, the remaining beverage containers 12 will reposition themselves via gravity to be adjacent the dispenser 32 for convenient access and removal from the package 10 by the user.

Additionally, a user may pivot the dispenser flap 34 to a closed position generally co-planar with the central panel 24 and reorient the package 10 after some of the containers 12 have been removed for convenient transport or further storage of the remaining containers 12, as needed. As such, the partially filled package 10 may then be laid on its side on a shelf 50 or remain upright for access to the remaining containers 12 as desired. Once all of the containers 12 are removed from the package 10, the overlay member 22 and overwrap member 44 may be discarded or recycled as desired.

Another aspect of this invention is shown in FIG. 1 in which the width of the dispenser opening 40 in a generally lateral direction on the overlay member 22 is identified as $d_1$. In a similar direction, the outer dimension, and in this case a diameter, of each container 12 in the package 10 is identified by reference numeral $d_2$. The orientation of the measurements $d_1$ and $d_2$ is in the same direction or parallel with one another. As is demonstrated in FIG. 1, $d_1$ is less than $d_2$ and this provides an advantage during assembly of the array 14 of containers 12 and the overlay member 22. Specifically, once the containers 12 are assembled in the array configuration, they can be slid on top of or relative to the generally planar central panel 24 in the lateral direction for the embodiment shown in FIG. 1. In this manner, since the dimension $d_2$ of each container 12 in that lateral direction is greater than the dispenser opening $d_1$ in the lateral direction, each container 12 will not tip, snag or be disrupted when sliding relative to the surface of the central panel 24 of the overlay member 22, including the dispenser opening 40. In other words, since the dimension $d_2$ of each container 12 is greater than the dimension $d_1$ in a corresponding direction, the containers 12 will not fall through, trip, snag or be disturbed by the opening 40 when the array 14 of containers 12 and overlay member 22 are mated together.

Figure 5:
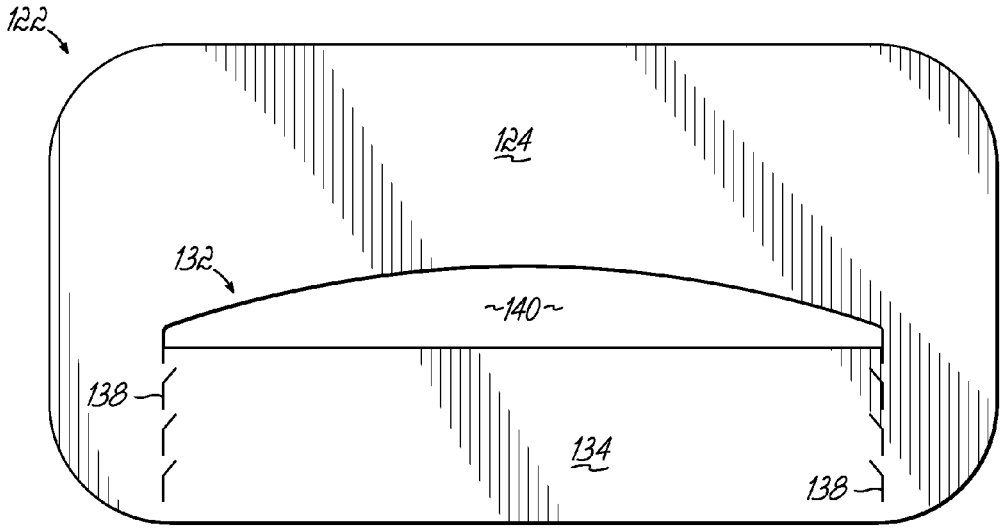
FIG. 5 is a top plan view of an alternative embodiment of an overlay member positioned on containers according to one aspect of this invention.
Figure 6:
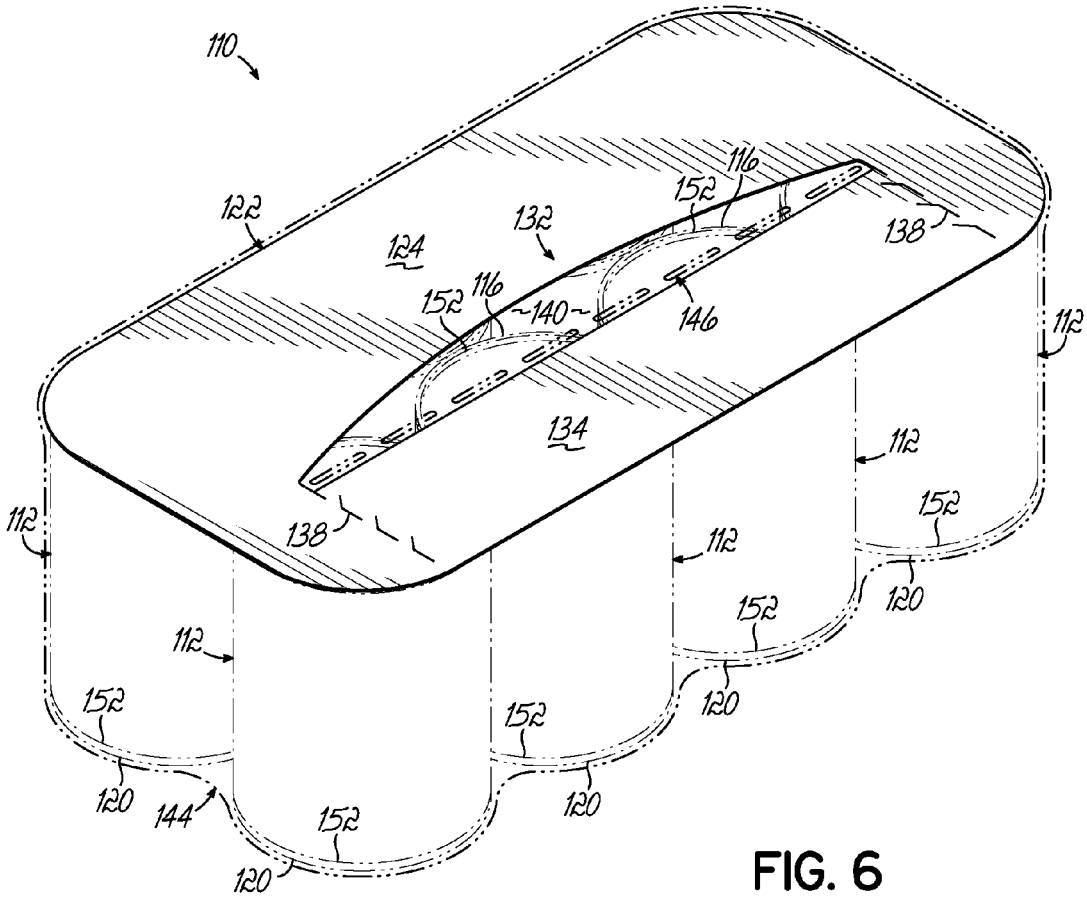
FIG. 6 is a perspective view of the overlay member and containers of FIG. 5 with the overwrap member applied thereto.
Figure 7:
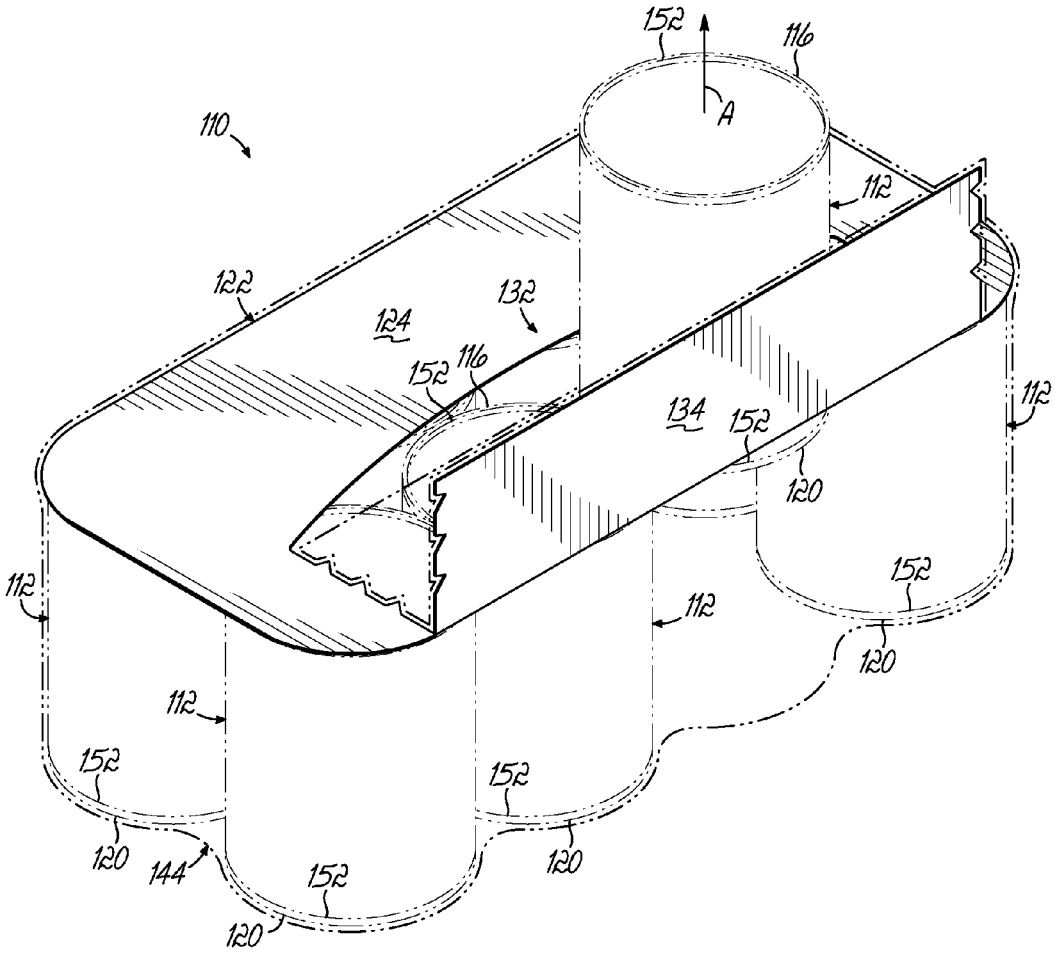
FIG. 7 is a view similar to FIG. 6 with the dispenser opened and one of the containers being removed in a generally vertical direction.

Referring to FIGS. 5-7, an alternative embodiment of an overlay member 122 and associated package 110 according to this invention is shown. With respect to the embodiment in FIGS. 5-7, elements which are the same as, similar to or comparable to corresponding elements in the embodiments of FIGS. 1-4 will have similar reference numerals in the 100 series of numbers. The overlay member 122 of FIGS. 5-7 includes the generally planar central panel 124 with the dispenser opening 140 and perforated tear lines 138 at the longitudinal ends of the dispenser opening 140; however, the overlay member 122 does not include the perimeter panels as in the embodiment in FIGS. 1-4. The package 110 includes an overwrap member 144 with a weakened portion 146 proximate the dispenser 132. The containers 112 in the embodiment of FIGS. 5-7 are generally right circular cylinders and each include protruding circumferential lips 152 at the top 116 and bottom 120 of each container 112. One example of a container 112 of this configuration which is well known in the marketplace is a non-beverage item such as pet food or the like. The circumferential lips 152 at the top and bottom of each container 112 may inhibit the containers 112 from being easily withdrawn from the package 110 through the dispenser 132 when the package 110 is positioned on its side as shown in FIG. 4. Therefore, the embodiment of this invention shown in FIGS. 5-7 may be useful for dispensing the containers 112 through the dispenser opening 140 in a generally vertical direction as shown by the arrow A in FIG. 7. As shown in FIG. 7, the dispenser flap 134 of the package 110 has been torn along the tear lines 138 so that it is in a generally vertical orientation and perpendicular to the overlay member 122. As such, one of the containers 112 may be withdrawn from the package 110 in a generally vertical direction while other containers 112 remain exposed in the package 110 for handy access.

Figure 8:
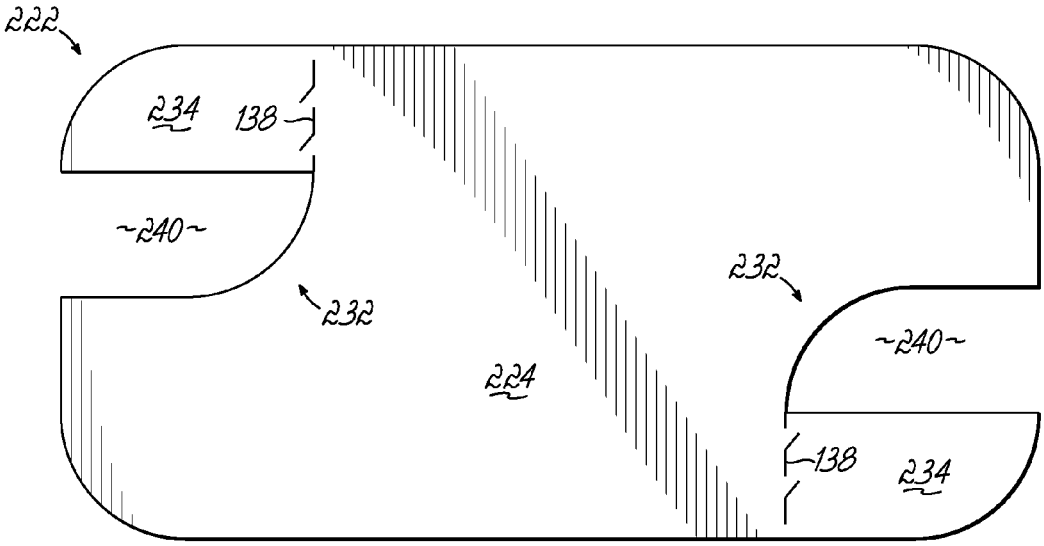
FIG. 8 is a top plan view of a further alternative embodiment of an overlay member according to one aspect of this invention.
Figure 9:
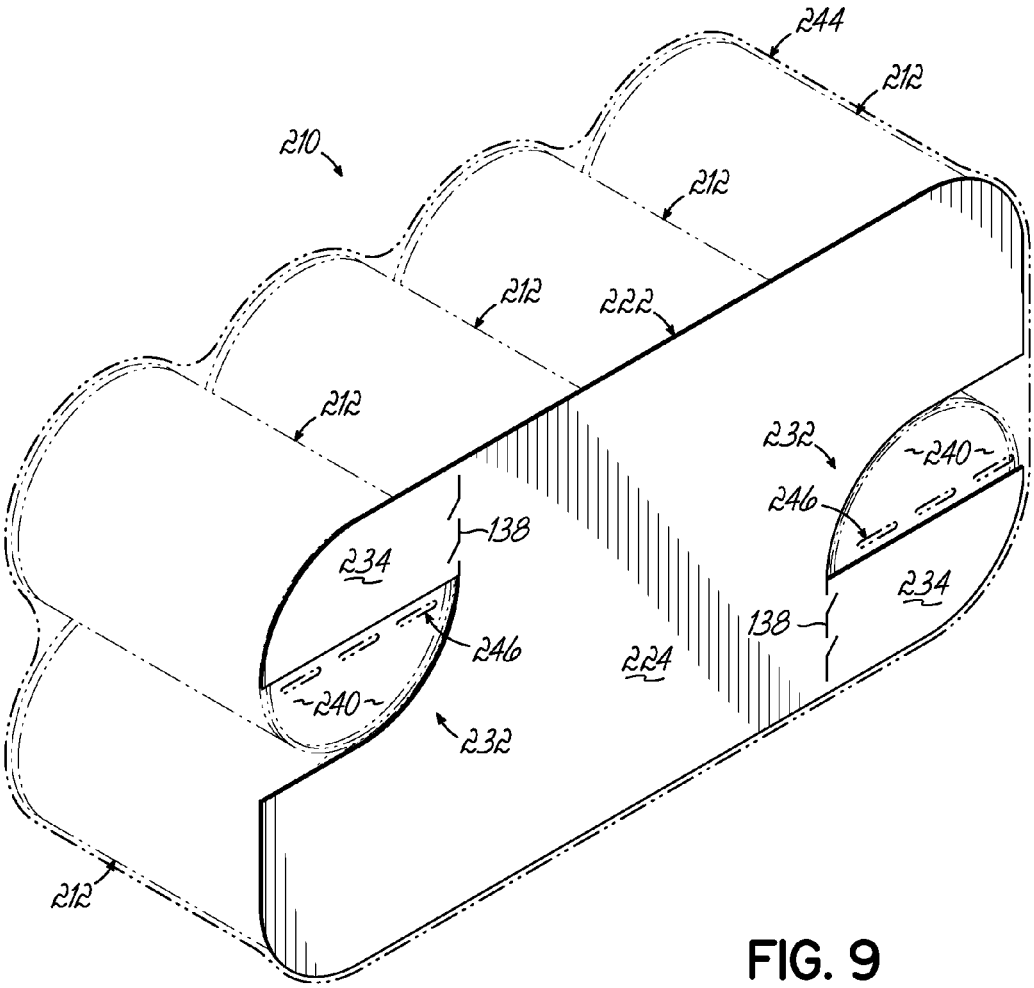
FIG. 9 is a perspective view of a package utilizing the overlay member of FIG. 8.
Figure 10:
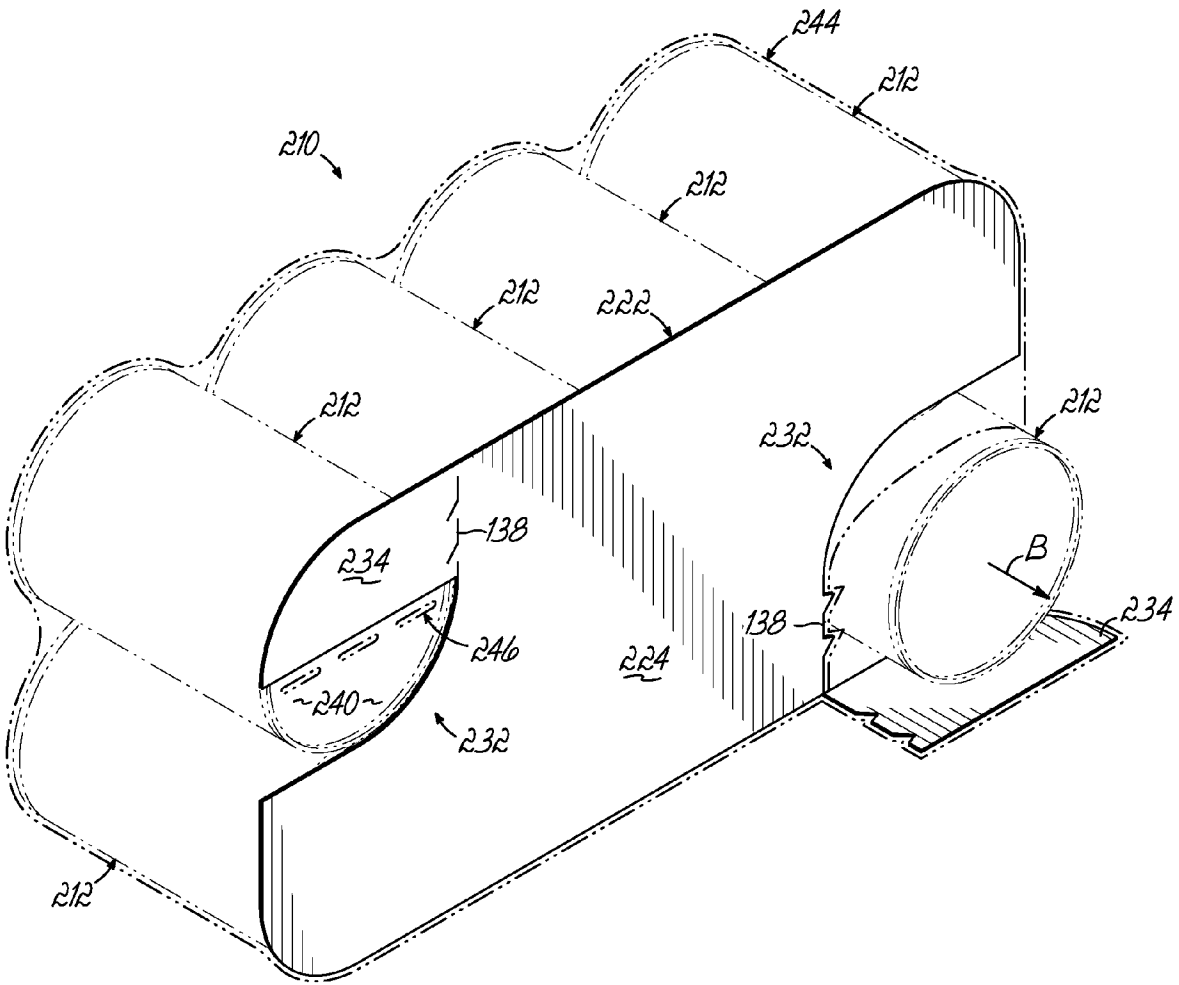
FIG. 10 is a view similar to FIG. 9 with the dispenser opened and one of the containers being removed in a generally horizontal direction.

A still further embodiment of a package 210 according to this invention is shown in FIGS. 8-10 in which, once again, similar elements with respect to previous embodiments of this invention in FIGS. 1-7 are shown with similar reference numerals in the 200 series. The overlay member 222 of the embodiment of the package 210 according to this invention shown in FIGS. 8-10 is generally planar and does not include the perimeter panels of the first embodiment of FIGS. 1-4. The package 210 includes an overwrap member 244 with a weakened portion 246 proximate the dispenser 232. The overlay member 222 and associated package 210 of FIGS. 8-10 includes multiple dispensers, two of which are shown in FIGS. 8-10, on opposing corners of the generally rectangular overlay member 222. In this manner, the user may conveniently position the package 210 in a variety of different orientations for removal of the containers 212 from the package 210 through one or both of the dispensers 232. Each dispenser 232 in the embodiment of FIGS. 8-10 is positioned adjacent not only the longitudinal edge of the overlay member 222, but also a lateral edge such that the dispenser 232 is generally in the corner of the overlay member 222 and associated package 210. In this manner, the dispenser flap 234 includes only one of the dispenser tear lines 238 in that the opposite edge of the dispenser flap 234 includes the free edge of the overlay member 222. The dispenser opening 240 of the exemplary embodiment shown in FIGS. 8-10 is particularly designed, sized and configured for removal of one of the containers 212 at a time through each dispenser 232 as shown in FIG. 10. More particularly, the package 210 of the embodiment shown in FIG. 10 is oriented on its side so that the dispenser flap 234 when torn from the remainder of the overlay member 222 is generally horizontal and perpendicular to the vertical orientation of the overlay member 222. In this manner, the containers 212 are withdrawn in a generally horizontal direction as shown by arrow B in FIG. 10. The package 210 in the orientation shown in FIGS. 9-10 may be supported on a shelf of a pantry, storage cabinet or refrigerator for convenient access and removal of the containers 212 from the package. After each container 212 is removed from the package 210, the containers 212 remaining in the package 210 will re-orient themselves, by gravity or otherwise, within the package 210 so that remaining containers 212 are accessible for subsequent removal through the dispenser 232.

The package 10, 110, 210 according to any embodiment of this invention may include finger holes in the overlay member and/or overwrap member for insertion of a user's fingers for carrying and transport of the package prior to or after the dispenser 32, 132, 232 has been accessed.

From the above disclosure of the general principles of the present invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A package comprising:

a plurality of containers arranged in an array and each having a longitudinal end;

an overlay member positioned proximate the longitudinal ends of the containers;

a dispenser formed within the overlay member, the dispenser including a dispenser opening;

a dispenser flap adjacent the dispenser opening and adapted to be pulled outwardly from the overlay member while remaining attached to the overlay member to provide at least in part the dispenser opening through which at least one of the containers may be removed from the package;

an overwrap member enveloping at least a substantial portion of the array of containers and the overlay member;

wherein the dispenser is positioned adjacent a perimeter edge of the overlay member; and a portion of the overwrap member being weakened relative to a remainder of the overwrap member and being positioned relative to the dispenser to allow a user to puncture the overwrap member in the vicinity of the weakened portion and gain access to at least one of the containers via the dispenser.

2. The package of claim 1 wherein the package is supported on a shelf with a side of the package facing downwardly and the dispenser positioned proximate the downwardly facing side of the package and the shelf.

3. The package of claim 1 wherein the weakened portion of the overwrap member is selected from one of the following: a line of perforations in the overwrap member, a crease in the overwrap member and a fold in the overwrap member.

4. The package of claim 1 further comprising a plurality of the dispensers each located proximate opposite longitudinal edges of the overlay member.

5. The package of claim 1 wherein each of the containers is removed from the package in a generally vertical direction through the dispenser when the package is oriented with the overlay member being generally horizontal and each of the containers is removed from the package in a generally horizontal direction through the dispenser when the package is oriented with the overlay member being generally vertical.

6. The package of claim 1 wherein a dimension of the dispenser opening in a first direction perpendicular to the perimeter edge of the overlay member is less than an overall outer dimension of the longitudinal end of the container in a second direction parallel to the first direction.

7. The package of claim 1 wherein the dispenser is sized and configured to allow for only one container to exit the package at a time.

8. The package of claim 1 wherein the overlay member further comprises:

a central, generally planar panel positioned on the longitudinal ends of the containers;

wherein the dispenser is formed in the central panel and further comprises a plurality of perimeter panels each joined to and positioned on a perimeter of the central panel, each perimeter panel being oriented generally perpendicularly relative to the central panel.

9. The package of claim 1 wherein the overwrap member further comprises:

a film material shrink wrapped onto the plurality of containers and the overlay member.

10. The package of claim 1 wherein the array of containers includes a longitudinal and a lateral direction in which more containers are arranged in the longitudinal direction than in the lateral direction and the dispenser is aligned in the longitudinal direction.

11. The package of claim 1 wherein the overlay member and the overwrap member are configured to allow the containers remaining in the package after at least some of the containers are removed to re-position via gravity within the package to be proximate the dispenser.

12. The package of claim 1 wherein the dispenser flap is generally perpendicular to the overlay member after it has been pulled outwardly from the overlay member while remaining attached to the overlay member.

13. A package comprising:

a plurality of containers arranged in an array and each having a longitudinal end;

an overlay member positioned proximate the longitudinal ends of the containers;

a dispenser formed within the overlay member, the dispenser including a dispenser opening;

an overwrap member enveloping at least a substantial portion of the array of containers and the overlay member, the overwrap member being a film material shrink wrapped onto the plurality of containers and the overlay member;

wherein the dispenser is positioned adjacent a perimeter edge of the overlay member;

a dispenser flap adjacent the dispenser opening and adapted to be pulled outwardly from the overlay member while remaining attached to the overlay member to provide an enlarged opening through which at least one of the containers may be removed from the package; and a portion of the overwrap member being weakened relative to a remainder of the overwrap member and being positioned relative to the dispenser to allow a user to puncture the overwrap member in the vicinity of the weakened portion and gain access to at least one of the containers via the dispenser, wherein the weakened portion of the overwrap member is selected from one of the following: a line of perforations in the overwrap member, a crease in the overwrap member and a fold in the overwrap member;

wherein each of the containers is removed from the package in a generally vertical direction through the dispenser when the package is oriented with the overlay member being generally horizontal and each of the containers is removed from the package in a generally horizontal direction through the dispenser when the package is oriented with the overlay member being generally vertical.

14. The package of claim 13 wherein the package is supported on a shelf with a side of the package facing downwardly and the dispenser positioned proximate the downwardly facing side of the package and the shelf.

15. The package of claim 13 further comprising a plurality of the dispensers each located proximate opposite longitudinal edges of the overlay member.

16. The package of claim 13 wherein a dimension of the dispenser opening in a first direction perpendicular to the perimeter edge of the overlay member is less than an overall outer dimension of the longitudinal end of the container in a second direction parallel to the first direction.

17. The package of claim 13 wherein the overlay member and the overwrap member are configured to allow the containers remaining in the package after at least some of the containers are removed to re-position via gravity within the package to be proximate the dispenser.

18. The package of claim 13 wherein the dispenser flap is generally perpendicular to the overlay member after it has been pulled outwardly from the overlay member while remaining attached to the overlay member.

19. A package comprising:

a plurality of containers arranged in an array and each having a longitudinal end;

an overlay member positioned proximate the longitudinal ends of the containers;

a plurality of dispensers formed within the overlay member, each dispenser being positioned adjacent a longitudinal perimeter edge of the overlay member, each dispenser including a dispenser opening in the overlay member;

a plurality of dispenser flaps each being adjacent one of the dispenser openings and adapted to be pulled outwardly from the overlay member while remaining attached to the overlay member to provide an enlarged opening through which at least one of the containers may be removed from the package;

wherein a dimension of the dispenser opening in a first direction perpendicular to the associated longitudinal edge of the overlay member is less than an overall outer dimension of the longitudinal end of the container in a second direction parallel to the first direction;

an overwrap member enveloping at least a substantial portion of the array of containers and the overlay member; and portions of the overwrap member being weakened relative to a remainder of the overwrap member and each portion being positioned relative to one of the dispensers to allow a user to puncture the overwrap member in the vicinity of the weakened portion and gain access to at least one of the containers via the associated dispenser, wherein each of the weakened portions of the overwrap member is selected from one of the following: a line of perforations in the overwrap member, a crease in the overwrap member and a fold in the overwrap member;

wherein the package is supported on a shelf with a side of the package facing downwardly and at least one of the dispensers being positioned proximate the downwardly facing side of the package and the shelf.

20. The package of claim 19 wherein each of the dispenser flaps is generally perpendicular to the overlay member after it has been pulled outwardly from the overlay member while remaining attached to the overlay member.

* * * * *